US007195182B2

(12) United States Patent
Fischer et al.

(10) Patent No.: US 7,195,182 B2
(45) Date of Patent: Mar. 27, 2007

(54) DOSING DEVICE FOR FLUIDS, ESPECIALLY A MOTOR VEHICLE INJECTION VALVE

(75) Inventors: Bernhard Fischer, Töging A. Inn (DE); Bernhard Gottlieb, München (DE); Andreas Kappel, Brunnthal (DE); Enrico Ulivieri, München (DE)

(73) Assignee: Siemens Aktiengesellschaft, Munich (DE)

( * ) Notice: Subject to any disclaimer, the term of this patent is extended or adjusted under 35 U.S.C. 154(b) by 299 days.

(21) Appl. No.: 11/003,265

(22) Filed: Dec. 3, 2004

(65) Prior Publication Data

US 2005/0082380 A1 Apr. 21, 2005

Related U.S. Application Data

(63) Continuation of application No. PCT/DE03/01815, filed on Jun. 2, 2003.

(30) Foreign Application Priority Data

Jun. 14, 2002 (DE) ..... 102 26 649

(51) Int. Cl.

| | |
|---|---|
| ***B05B 1/30*** | (2006.01) |
| ***B05B 1/34*** | (2006.01) |
| ***F02M 59/00*** | (2006.01) |
| ***F02M 61/00*** | (2006.01) |
| ***F02M 47/02*** | (2006.01) |

(52) U.S. Cl. ..... 239/585.5; 239/585.3; 239/585.4; 239/585.1; 239/533.1; 239/533.2; 239/533.12; 239/88

(58) Field of Classification Search ..... 239/585.1, 239/585.3, 585.4, 585.5, 533.1, 533.2, 533.11, 239/533.12, 88–93; 251/129.15, 129.21, 251/127

See application file for complete search history.

(56) References Cited

U.S. PATENT DOCUMENTS

| | | | | |
|---|---|---|---|---|
| 5,544,816 | A * | 8/1996 | Nally et al. | 239/585.5 |
| 5,921,475 | A * | 7/1999 | DeVriese et al. | 239/585.4 |
| 5,996,911 | A * | 12/1999 | Gesk et al. | 239/585.1 |
| 6,328,232 | B1 * | 12/2001 | Haltiner et al. | 239/585.1 |
| 6,494,389 | B1 | 12/2002 | Reiter | 239/585.1 |
| 6,607,143 | B2 * | 8/2003 | Dallmeyer et al. | 239/5 |

FOREIGN PATENT DOCUMENTS

| | | |
|---|---|---|
| DE | 199 32 763 A1 | 1/2001 |
| DE | 199 58 704 A1 | 6/2001 |

* cited by examiner

*Primary Examiner*—Davis Hwu
(74) *Attorney, Agent, or Firm*—Baker Botts L.L.P.

(57) ABSTRACT

A dosing device comprises a housing (1) provided with an actuator, a dosing opening (8), a guiding shaft (6) which surrounds part of the valve needle (7) and forms a valve chamber (10) with the same, and a fluid chamber module (4) which is welded to the housing (1) in the form of a duct for guiding the valve needle (7) into the housing (9). The fluid chamber module (4) and the housing (1) are assembled along a separation surface (13) which is subjected to pressure by the dosing liquid and is formed almost only by axial cylinder wall surface parts (13) in order to reduce the pressure load on the weld seam (13).

10 Claims, 1 Drawing Sheet

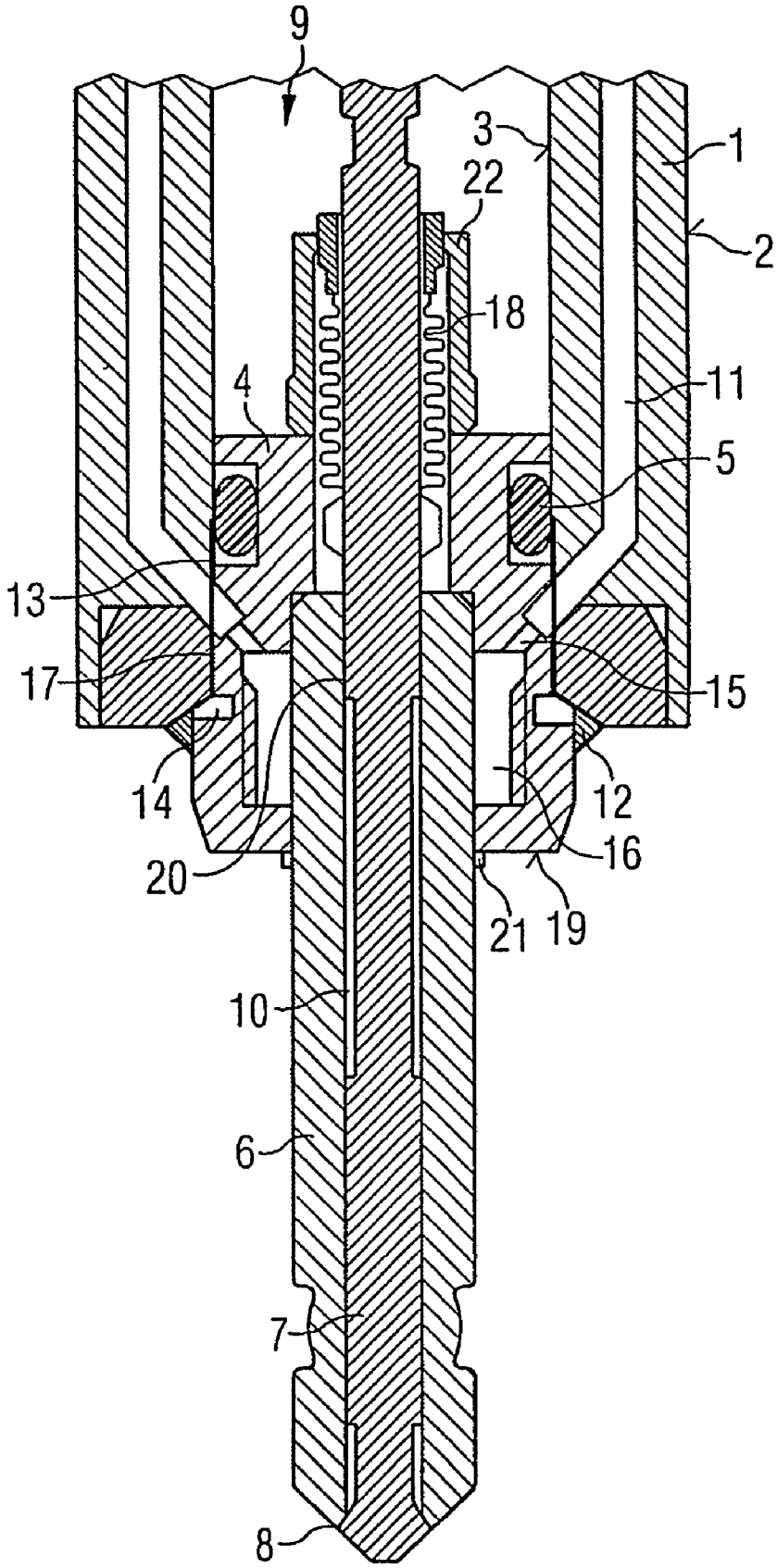
9
3
1
22
2
18
4
11
5
13
17
15
14
12
20
16
21
19
10
6
7
8

DOSING DEVICE FOR FLUIDS, ESPECIALLY A MOTOR VEHICLE INJECTION VALVE

CROSS REFERENCE TO RELATED APPLICATION

This application is a continuation of copending International Application No. PCT/DE03/01815 filed Jun. 2, 2003 which designates the United States, and claims priority to German application no. 102 26 649.2 filed Jun. 14, 2002.

TECHNICAL FIELD OF THE INVENTION

The present invention relates to a dosing device with an actuator which is accommodated in a housing and which drives a valve needle through which a highly pressurized fluid can be dosed. Devices of this kind, hereinafter also referred to as dosing valve or fluid doser, are used particularly as injection valves for internal combustion engines.

DESCRIPTION OF THE RELATED ART

In automotive engineering, injection systems are being increasingly used in which fuel is fed at high pressure (up to several hundred bar) to injection valves disposed in the cylinders. The process of injecting fuel directly into the combustion chamber of the cylinders is initiated by opening and closing of the injection valves, said injection valves being controlled via modern actuators which—in order to achieve the high switching speeds and the associated known advantages in respect of fuel consumption and exhaust emissions—increasingly employ the piezoelectric principle rather than the electromagnetic principle. With the modern solid-state actuators, the axial length variations generating the valve needle travel are known to be produced by the brief expansion of the actuator body when an exciter voltage is applied.

DE 199 58 704 A1 discloses a fluid doser having a device for transmitting an actuator movement, wherein the valve needle and a wall of the housing together form a fluid-pressurizable valve chamber leading to the dosing orifice. The valve chamber is preceded by a fluid chamber disposed in the housing. This area in the housing of the injection valve in which the very high fuel pressure is present should be reliably sealed from the other areas of the housing, in particular from the actuating area in which e.g. ambient pressure obtains. For this purpose there is provided between said areas a hermetically sealed and axially soft needle feedthrough basically comprising a horizontal connecting ring whose annular surface is therefore disposed perpendicularly to the axis of the injection valve. The connecting ring through which the valve needle passes is disposed adjacently to the fluid chamber and rigidly welded to the housing of the injection valve.

With the known fluid doser, problems arise with respect to the durability of the welded joint between the connecting ring and the housing. These problems are attributable to the stress exerted by powerful pressure forces in conjunction with pressurization by the dosing fluid. These problems also arise in a similar manner with injection valves in which the connecting ring, fluid chamber and needle feedthrough—unlike in the arrangement described in DE 199 58 704 A1—constitute a structural entity in the form of a fluid chamber module which fits together with the housing along a pressure-loaded stepped interface and is welded to the housing where said interface abuts the outside of the housing.

SUMMARY OF THE INVENTION

One object of the present invention is to provide a depressurized dosing device having a fluid chamber module welded to the housing, wherein in particular the welded joint exhibits a high degree of durability even when subjected to fluid pressures of up to several hundred bar.

Another object is to ensure a high degree of durability also with respect to the fluid pressure waves occurring when the injection valve opens and closes during operation.

This object can be achieved according to the invention by dosing device for dosing a pressurized fluid, comprising a housing with an actuator chamber for accommodating an actuator, a dosing orifice which is controllable by means of an actuator-induced axial displacement of a valve needle, a fluid chamber module disposed in the area of the orifice end of the housing and welded to said housing, a guide shaft which encloses one part of the valve needle and together with it forms a valve chamber, one end of the guide shaft together with one end of the valve needle forming the dosing orifice, while the other end of the valve needle extends through the fluid chamber module into the housing interior, and the other end of the guide shaft is retained on the fluid chamber module, a line hydraulically connecting the valve chamber to a high-pressure port for a dosing fluid, the fluid chamber module and the housing being fitted together along a pressure-loaded interface pressurized by the dosing fluid and formed virtually only by axial cylindrical wall surface portions.

To this end the dosing device for dosing a pressurized fluid has a housing with an actuator chamber for accommodating an actuator, a dosing orifice which is controllable by means of an axial valve needle displacement initiated by the actuator, a fluid chamber module disposed in the region of the orifice end of the housing and welded to said housing, and a guide shaft which encloses one part of the valve needle and together with it forms a valve chamber, one end of the guide shaft together with one end of the valve needle forming the dosing orifice, while the other end of the valve needle extends through the fluid chamber module into the housing interior, and the other end of the guide shaft is retained on the fluid chamber module.

There is additionally provided a line hydraulically connecting the valve chamber to a high pressure port for a dosing fluid, the fluid chamber module and the housing being fitted together along an interface pressure-loaded by the pressurized dosing fluid, said interface being formed virtually only by the axial cylinder wall surface portions.

The invention is based first and foremost on the knowledge that the interface pressure-loaded by the dosing fluid is essentially formed by horizontal annular surface portions and vertical cylinder wall surface portions, each resulting in pressure forces having quite different effects. "Horizontal" (or perpendicular) and "vertical" (or axially parallel) refer to the dosing valve's axis of symmetry defined by the valve needle.

Further consideration reveals that powerful pressure forces driving the housing and fluid chamber module apart are created particularly on the horizontal annular surface portions of the interface between housing and fluid chamber module, or on other surface portions having a corresponding effect due to a horizontal directional component. These pressure forces therefore stress the weld directly and to a considerable degree. For typical dimensions of the pressurized horizontal circular ring surfaces with an internal diameter of approximately 14 mm and an external diameter of approximately 23 mm, a separating force of approximately 5400 N is produced at a typical fuel pressure of approximately 200 bar. In addition to static pressure loading, slowly decaying pressure waves with an amplitude of approximately 20% to 50% of the static operating pressure occur when the injector is opened and closed. This means that the basic force of 5400 N exerted on the weld is overlaid by an oscillating load having an amplitude of up to 2700 N. Calculations performed in this connection show that such high forces in the weld actually result in considerable mechanical stresses far exceeding the permissible material stresses. In actual use of the injector, premature weld breakages occur, resulting in injector failures.

On the other hand, axially parallel-oriented pressure-loaded cylinder outer surfaces place little or no load on the weld, as the pressure forces are mutually compensating because of the cylinder symmetry and the housing and fluid chamber module are mechanically very rigid in the radial direction. The radial pressure forces are neither capable of compressing the fluid chamber module in the radial direction nor of appreciably widening the housing radially, so that they cause no or only slight mechanical stress in the weld.

According to the invention it is therefore possible to achieve a mechanical design of the arrangement or connection of housing and fluid chamber module that is optimum in terms of the durability of the welded joint by very largely avoiding pressure-loaded horizontal interface portions.

A preferred embodiment can be achieved in that the fluid chamber module is inserted in a plug-like manner into the orifice end of the housing, that the housing encloses the fluid chamber module up to the end face area of the housing with full wall thickness, and that fluid chamber module and housing are welded to the end face area of the housing by means of an annular weld.

BRIEF DESCRIPTION OF THE DRAWINGS

The invention will now be described with reference to an exemplary embodiment illustrated in the drawing.

The single drawing schematically illustrates an axial section through the valve-needle-end section of the dosing device according to the invention.

DETAILED DESCRIPTION OF THE PREFERRED EMBODIMENTS

The FIGURE shows the lower part of the housing 1 of an essentially cylinder-symmetrical injection valve with the outer housing wall 2 and the inner housing wall 3. Adjacently to the inner housing wall 3 there is fitted a fluid chamber module 4 fulfilling a plurality of functions. In the upper area of the fluid chamber module 4 there can be provided, as shown, a sealing ring 5. A guide shaft 6 is introduced or inserted centrally into the fluid chamber module 4. The guide shaft 6 encloses a valve needle 7 and forms with said valve needle 7 a valve chamber 10 and at the lower end a dosing orifice 8 of a seated valve. The other end of the guide shaft 6 bears on an annular bearing surface of the fluid chamber module 4. The guide shaft 6 is typically welded to the fluid chamber module 4 at the outlet area 21 of same. The valve needle 7 extends through the fluid chamber module 4 into the housing interior 9.

The housing interior 9 can contain a separate actuator chamber for the valve drive (actuator) not shown in the FIGURE, or it can itself directly form the actuator chamber. In the housing interior 9 there can be provided, in addition to the actuator, hydraulic devices and chambers, e.g. for a stroke converter or a hydraulic length compensator.

The feedthrough of the valve needle 7 through the fluid chamber module 4 can contain further elements, as shown in the FIGURE. In order to achieve a hermetically sealed and axially very soft feedthrough, a metal bellows 18 can preferably be provided. A lower end of the metal bellows 18 is welded to the valve needle 7 and its upper end is welded to the upper end of another guide shaft 22 which is part of the fluid chamber module 4. The cylindrical metal bellows 18 is connected in a circumferentially sealing manner to the valve needle 7 at one end and, at the other end, to the cylindrical inner walls of the other guide shaft 22 of the fluid chamber module 4. In this way the valve chamber 10 is sealed from the housing interior 9.

Due to the virtually complete absence of horizontal pressure-loaded circular ring surfaces, the inventive design, or more precisely the pressure-loaded interface 13 formed virtually only by axial cylinder wall surface portions 13 avoids the high separating forces otherwise occurring between housing 1 and fluid chamber module 4. As the FIGURE shows, it is possible to avoid the horizontal pressure-active interfaces by extending the housing 1 around the fluid chamber module 4 further downward in full wall thickness and ensuring that the fluid chamber module 4 essentially has a diameter corresponding to the diameter of the inner housing wall 3 without projections into the wall of the housing 1.

There is preferably provided at the end face area 19 of the housing 1 a radially inward oriented transverse shoulder which engages in a (circumferential) groove 14 provided externally on the fluid chamber module 14 and which is disposed immediately adjacent to the weld 12. This enables the housing 1 and fluid chamber module 4 to fit together in a more stable manner, while horizontal pressure surfaces according to the invention are additionally very greatly reduced.

The unrestricted fluidic connection between housing 1 and fluid chamber module 4 can be produced by vertical and corresponding slanted bores 11 in the housing 1. These bores 11 therefore carry the dosing fluid, in this case the fuel, from the high-pressure port (not shown) located in the upper part of the injector downward to the fluid chamber module 4. The fuel must be forwarded into the valve chamber 10 and finally to the dosing orifice 8. Bores 15 are provided in the fluid chamber module 4 for this purpose. The fuel is introduced into the valve needle chamber 10 between the valve needle 7 and guide shaft 6 below the upper valve needle guide 20 via a fluid chamber (16) disposed in the fluid chamber module 4 and bores (not shown) in the guide shaft 6. In place of the bores 11 a fuel line can also be formed by comprising the housing 1 of two intercalated cylinder walls which bound the fuel line housing 1.

An annular groove 17 can be provided in the housing 1 and/or the fluid chamber module 4 so that, during assembly and welding, attention does not need to be paid to the orientation of the housing 1 and fluid chamber module 4 in respect of their rotational angle relative to the axis of symmetry, and corresponding fuel bores 11 and 15 of the housing 1 and fluid chamber module 4 respectively are reliably aligned or fluidically interconnected.

The FIGURE also illustrates the sealing function of the fluid chamber module 4 which has a cylindrical outer surface forming, with the cylindrical inner surface 3 of the housing 1, an axial sealing surface essentially coinciding with the interface 13 between the housing interior 9 and the areas of the fluid chamber module 4 pressurizable with dosing fluid, particularly the fluid chamber 16.

Advantageously, powerful static as well as dynamic pressure-induced forces acting on the connecting weld 12 between housing 1 and fluid chamber module 4 just do not occur with the easily manufacturable construction according to the invention, thereby reliably ensuring the durability of the welded joint.

We claim:

1. A dosing device for dosing a pressurized fluid, comprising:

a housing with an actuator chamber for accommodating an actuator, a dosing orifice which is controllable by means of an actuator-induced axial displacement of a valve needle, a fluid chamber module disposed in the area of the orifice end of the housing and welded to said housing, a guide shaft which encloses one part of the valve needle and together with it forms a valve chamber, one end of the guide shaft together with one end of the valve needle forming the dosing orifice, while the other end of the valve needle extends through the fluid chamber module into the housing interior, and the other end of the guide shaft is retained on the fluid chamber module, a line hydraulically connecting the valve chamber to a high-pressure port for a dosing fluid, the fluid chamber module and the housing being fitted together along a pressure-loaded interface pressurized by the dosing fluid and formed virtually only by axial cylindrical wall surface portions.

2. The dosing device according to claim 1, wherein the fluid chamber module is inserted in a plug-like manner into the orifice end of the housing, the housing encloses the fluid chamber module up to the end face area of the housing with full wall thickness, and fluid chamber module and housing are welded together by means of an annular weld at the end face area of the housing.

3. The dosing device according to claim 1, wherein there is provided at the end face area of the housing a radially inward oriented transverse shoulder which engages in a groove provided externally on the fluid chamber module and which is disposed immediately adjacent to the weld.

4. The dosing device according to claim 1, wherein the line is provided by bores in the housing and in the fluid chamber module and a fluidic connecting annular groove in the housing and/or in the fluid chamber module.

5. The dosing device according to claim 1, wherein the fluid chamber module has a cylindrical outer surface forming with a cylindrical inner surface of the housing an axial sealing surface essentially coinciding with the interface between the housing interior and the dosing-fluid-pressurizable areas of the fluid chamber module.

6. An injection valve comprising:

a housing with an actuator chamber for accommodating an actuator, a dosing orifice which is controllable by means of an actuator-induced axial displacement of a valve needle, a fluid chamber module disposed in the area of the orifice end of the housing and welded to said housing, a guide shaft which encloses one part of the valve needle and together with it forms a valve chamber, one end of the guide shaft together with one end of the valve needle forming the dosing orifice, while the other end of the valve needle extends through the fluid chamber module into the housing interior, and the other end of the guide shaft is retained on the fluid chamber module, a line hydraulically connecting the valve chamber to a high-pressure port for a dosing fluid, wherein the fluid chamber module and the housing being fitted together along a pressure-loaded interface pressurized by the dosing fluid and formed virtually only by axial cylindrical wall surface portions and wherein the fluid chamber module comprises a diameter corresponding to a diameter of an inner housing wall without projections into the wall of the housing.

7. The dosing device according to claim 6, wherein the fluid chamber module is inserted in a plug-like manner into the orifice end of the housing, the housing encloses the fluid chamber module up to the end face area of the housing with full wall thickness, and fluid chamber module and housing are welded together by means of an annular weld at the end face area of the housing.

8. The dosing device according to claim 6, wherein there is provided at the end face area of the housing a radially inward oriented transverse shoulder which engages in a circumferential groove provided externally on the fluid chamber module and which is disposed immediately adjacent to the weld.

9. The dosing device according to claim 6, wherein the line is provided by bores in the housing and in the fluid chamber module and a fluidic connecting annular groove in the housing and/or in the fluid chamber module.

10. The dosing device according to claim 6, wherein the fluid chamber module has a cylindrical outer surface forming with a cylindrical inner surface of the housing an axial sealing surface essentially coinciding with the interface between the housing interior and the dosing-fluid-pressurizable areas of the fluid chamber module.

* * * * *